US006475295B1

(12) United States Patent
Bohnes et al.

(10) Patent No.: US 6,475,295 B1
(45) Date of Patent: Nov. 5, 2002

(54) METHOD FOR CLEANING THE PAINT FEEDING PARTS OF A PAINTING INSTALLATION, ESPECIALLY THE PAINT LINES

(75) Inventors: Alfred Bohnes, Cologne (DE); Johannes Lindemann, Rheinbreitbach (DE); Karl Manderscheid, Huerth-Fischenich (DE); Dirk Bohnes, Kerpen (DE)

(73) Assignee: Aware Chemicals L.L.C., Miami, FL (US)

( * ) Notice: Subject to any disclaimer, the term of this patent is extended or adjusted under 35 U.S.C. 154(b) by 0 days.

(21) Appl. No.: 09/720,153

(22) PCT Filed: Jun. 17, 1999

(86) PCT No.: PCT/EP99/04194

§ 371 (c)(1),
(2), (4) Date: Mar. 29, 2001

(87) PCT Pub. No.: WO00/00579

PCT Pub. Date: Jan. 6, 2000

(30) Foreign Application Priority Data

Jun. 26, 1998 (AT) ..... 1114/98

(51) Int. Cl.[7] ..... B08B 3/04

(52) U.S. Cl. ..... 134/38; 134/2; 134/22.1; 134/22.11; 134/22.14; 134/22.19; 134/36; 134/42; 510/201; 510/434

(58) Field of Search ..... 510/201, 434; 134/36, 38, 42, 2, 22.1, 22.11, 22.14, 22.19

(56) References Cited

U.S. PATENT DOCUMENTS

| | | | | |
|---|---|---|---|---|
| 5,284,512 A | | 2/1994 | Koskan et al. | 106/416 |
| 5,443,748 A | | 8/1995 | Bergishagen et al. | 252/162 |
| 5,468,838 A | | 11/1995 | Boehmke et al. | 528/363 |
| 5,523,023 A | | 6/1996 | Kleinstueck et al. | 525/542 |
| 5,610,255 A | | 3/1997 | Groth et al. | 526/304 |
| 5,658,464 A | | 8/1997 | Hann et al. | 210/697 |
| 5,714,558 A | | 2/1998 | Groth et al. | 526/312 |
| 5,830,985 A | | 11/1998 | Kroner et al. | 528/328 |
| 6,034,046 A | * | 3/2000 | Blanvalet et al. | 510/235 |
| 6,231,680 B1 | * | 5/2001 | Gerlach et al. | 134/2 |
| 6,432,220 B1 | * | 8/2002 | Lindemann et al. | 134/41 |

FOREIGN PATENT DOCUMENTS

| | | |
|---|---|---|
| DE | 43 05 368 | 8/1994 |
| DE | 43 06 412 | 9/1994 |
| DE | 43 10 503 | 10/1994 |
| DE | 43 10 995 | 10/1994 |
| DE | 43 23 191 | 1/1995 |
| DE | 44 27 233 | 1/1996 |
| DE | 44 28 639 | 2/1996 |
| EP | 0 474 869 | 3/1992 |
| WO | WO/98/22205 | 5/1989 |
| WO | WO 92/15535 | 9/1992 |

* cited by examiner

*Primary Examiner*—Sharidan Carrillo
(74) *Attorney, Agent, or Firm*—Stephen D. Harper

(57) ABSTRACT

A method for cleaning paint carrying parts of a paint shop, especially the paint lines, is described, wherein the paint carrying parts are rinsed with a liquid containing an organic solvent. In order to obtain particularly advantageous conditions, polyaspartic acid is mixed with the rinsing liquid.

6 Claims, No Drawings

METHOD FOR CLEANING THE PAINT FEEDING PARTS OF A PAINTING INSTALLATION, ESPECIALLY THE PAINT LINES

BACKGROUND OF THE INVENTION

1. Field of the Invention

This invention relates to a process for cleaning paint-carrying parts of a paint shop, more particularly paint lines, the paint-carrying parts being rinsed with a rinsing liquid containing an organic solvent.

2. Discussion of the Related Art

All the paint-carrying parts of a paint shop have to be cleaned to remove adhering paint particles and paint residues at least whenever the paint to be processed is changed, for example in its composition or color, or when, for example, the paint shop has to be closed down or maintained. The cleaning of the paint-carrying parts, especially paint lines, can be carried out simply by rinsing, suitable organic solvents being added to the rinsing liquids. After the paint-carrying parts have been cleaned, the spent rinsing liquid has a high organic solvent content of up to 15% by weight, with the result that the spent rinsing liquid has to be expensively disposed of.

SUMMARY OF THE INVENTION

Accordingly, the problem addressed by the present invention was to develop a process for cleaning paint-carrying parts of a paint shop, more particularly paint lines, of the type mentioned at the beginning in such a way that not only would the cleaning effect be improved, but there would also be no need for expensive disposal of the spent rinsing liquid.

According to the invention, the problem stated above is solved by addition of polyaspartic acid as solvent to the rinsing liquid.

DETAILED DESCRIPTION OF THE INVENTION

Through the use of polyaspartic acid, which is produced in known manner (DE 43 05 368 A1, DE 43 06 412 A1, DE 43 10 503 A1, DE 43 23 191 A1, DE 44 27 233 A1, DE 44 28 639 A1) and which, hitherto, has been used above all as an additive in detergents, deposits of paint can be surprisingly effectively detached from the paint-carrying parts and kept in dispersion, because the polyaspartic acid additionally prevents the detached paint residues from sticking together, so that the dissolved paint residues cannot be redeposited in the paint-carrying parts. Since, in addition, the polyaspartic acid remains dissolved in the rinsing liquid, normally water, the rinsing liquid can be circulated after suitable separation of the dissolved paint particles so that there is no need to dispose of the spent rinsing liquid. Small losses of polyaspartic acid—which is of course harmless to the environment—accompanying the losses of rinsing liquid can be correspondingly corrected.

It has been found in practice that a good cleaning effect can be obtained with a minimum content of only 2% by volume of polyaspartic acid in the rinsing liquid. In most cases, it is sufficient to add the polyaspartic acid to the rinsing liquid in a quantity of 2 to 5% by volume. With a polyaspartic acid concentration of this order, paint particles can readily and effectively be prevented from sticking together, up to a paint content in the rinsing liquid of 10% by volume or more. If necessary, the polyaspartic acid concentration can be adapted to the particular paint content of the rinsing liquid.

It presumably need not be especially emphasized that, besides the polyaspartic acid, other organic auxiliaries, such as solubilizers, wetting agents and corrosion inhibitors, may also be added to the rinsing liquid in order to support the cleaning effect. However, it is essential to use the polyaspartic acid both to detach the paint deposits from the paint-carrying parts of a paint shop and as a dispersant for the detached paint particles to prevent them from sticking to one another and from being redeposited in the paint-carrying parts.

In standard industrial paint shops, the excess paint accumulating is washed out, for example, from the waste air of painting cubicles and recovered from the washing water, which is circulated. The effect of polyaspartic acid in preventing the paint particles washed out from sticking together may also be utilized with advantage for this circuit water, in which case particularly simple cleaning conditions are established for the paint-carrying parts of a normal paint shop because the rinsing liquid to which the polyaspartic acid is added can be directly discharged into the water circuit of the paint shop after those parts of the paint shop to be cleaned have been rinsed through, so that there is no need for separate facilities for treating the rinsing liquid or for separating the dissolved paint particles.

What is claimed is:

1. A process for removing paint from a paint-carrying part of a paint shop comprising providing a composition comprising a rinsing liquid and polyaspartic acid and removing said paint by contacting said part with said composition.

2. A process as claimed in claim 1, wherein polyaspartic acid is present in the rinsing liquid in a concentration of 2 to 5% by volume.

3. A process as claimed in claim 1, wherein the rinsing liquid is water.

4. A process as claimed in claim 1 wherein the composition is additionally comprised of at least one organic auxiliary selected from the group consisting of solubilizers, wetting agents and corrosion inhibitors.

5. A process as claimed in claim 1 wherein said part is a paint line.

6. A process as claimed in claim 2, wherein the rinsing liquid is water.

* * * * *